United States Patent [19]

Seeley et al.

[11] 4,021,060

[45] May 3, 1977

[54] MULTIPART BUSINESS FORM OR MANIFOLD HAVING STRIPPABLE LABEL

[75] Inventors: Dunham Briggs Seeley, Fairport; David Robert Hassel, Rochester, both of N.Y.

[73] Assignee: Burroughs Corporation, Detroit, Mich.

[22] Filed: Sept. 8, 1975

[21] Appl. No.: 611,257

[52] U.S. Cl. ..... 282/28 R; 156/277

[51] Int. Cl.[2] ..... B41L 1/16

[58] Field of Search ..... 40/125 A; 156/289; 282/22 R, 27.5, 28 R; 428/202, 352, 484

[56] References Cited

UNITED STATES PATENTS

| | | | |
|---|---|---|---|
| 1,843,432 | 2/1932 | Nickerson | 156/289 X |
| 2,070,918 | 2/1937 | Peterson | 428/484 X |
| 2,167,711 | 8/1939 | Dalton | 428/484 |
| 2,308,900 | 1/1943 | Tryon | 428/202 X |
| 2,896,351 | 7/1959 | Johnson | 40/125 A X |
| 3,383,121 | 5/1968 | Singer | 282/28 R |

*Primary Examiner*—Harland S. Skogquist
*Attorney, Agent, or Firm*—Kevin R. Peterson; William B. Penn; Lynn L. Augspurger

[57] ABSTRACT

Disclosed is a multipart business form or manifold having a strippable label with pressure sensitive adhesive which may be removed from the form leaving a copy beneath exposed to view. Also disclosed is the method and apparatus for producing the form.

6 Claims, 3 Drawing Figures

MULTIPART BUSINESS FORM OR MANIFOLD HAVING STRIPPABLE LABEL

BACKGROUND OF THE INVENTION

This application relates to multipart business forms or manifolds which have strippable labels forming a part of the manifold.

Manifolds have become so widely used that there are many types commercially available. These multipart business forms are utilized for "Speed-O-Letters," others are utilized for multipart invoices and packing labels and still others are designed for special use such as for prescription drug labels and the records associated therewith. Some of these manifolds have carbon paper interleaves while others employ so-called "NCR" or "Action" brand paper, respectively products of the NCR Corporation and Minnesota, Mining and Manufacturing Company, which may be described as carbonless transfer paper, in which the impact of the material with type or other instruments induces a colored substance to produce an image in the area of impact, as for instance described in the U.S. Pat. Nos. 2,550,473 and 3,020,171.

Besides being used as manifolds, these papers have been used to produce copy labels such as those which are sold by the Fasson Division of Avery Products Division, described generally in U.S. Pat. No. 3,383,121, marketed as "FasCopy".

The FasCopy products are pressure sensitive labels printed on stock made in accordance with U.S. Pat. No. 3,383,121. The liner or backing sheet is an encapsulated release liner which reproduces all information printed on the FasCopy stock so as to provide a record of data reproduced thereon. Typically the label is first produced by impace (letterpress) printing and then the particular information which differs from label to label (as a customer address) is entered by a typewriter or by handwriting. All printing and handwriting is reproduced on the release liner. This release liner is formed of a laminate of Action brand carbonless transfer paper and a coating sheet of glassine type paper or polyethylene. The coating sheet is further coated over the entire surface with a silicone which acts as the release coating for the release liner or label backing sheet which is stripped from the label.

In one sample the backing sheet also has an adhesive on the back so that it may be affixed to another preprinted form, e.g., the income tax mailer.

SUMMARY OF THE INVENTION

The present invention is directed to an improved manifold or multipart printed business form which has incorporated therein a strippable label which leaves behind on the following ply a copy of the material added to the label after manufacture, and yet eliminates the separate release liner. The form has one or more plies preprinted during manufacture and all plies are usable and functional parts of the whole manifold. There are no separate release sheets which must be removed and discarded. An adjacent printing ply is coated with a vegetable wax or other release agent, permitting release of a cover label and use of the ply as a part of the form.

The process and apparatus for making the manifold which permits the use of roll fed rotaries for printing as the manifolds are manufactured today form a plurality of preprinted rolls. The web is first printed and then with the addition of a hot wax stripper or spot applicator to existing commercial printing equipment, the web which will form a ply of the manifold is printed and coated with the preferred vegetable waxes, as hydrogenated castor oil. This permits, by the utilization of existing equipment for printing, a minimum of capital expenditure yet a high production - low cost manufacture for the new manifold.

BRIEF DESCRIPTION OF THE DRAWINGS

For a further elaboration of the invention in its preferred embodiment, reference should be had to the accompanying drawings.

PREFERRED EMBODIMENT OF THE INVENTION

Figure 1:
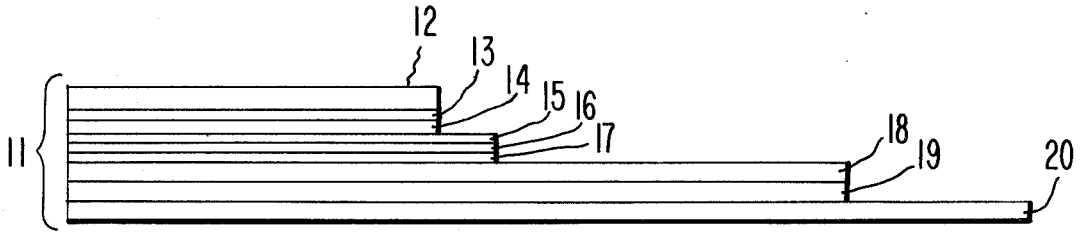
FIG. 1 is a section of the manifold according to the invention.

The manifold 11 is composed of a plurality of sheets or plys of paper stock 12, 15, 18, 19 and 20. While in the embodiment shown there are a plurality of strippable labels 12, 15, as part of the plies it will be recognized that the form can have certain of the plies omitted, for instance, ply 15 and/or 18, and/or 19 could be omitted.

It is preferred that all but the first ply consist of carbonless transfer papers such as NCR SC, CF, CFB, CB or SCCB. These papers can be obtained commercially from the NCR Corporation.

We prefer that the first ply 12 be a high gloss label stock, and have found that the stock called KromeKote (Trademark) manufactured by the Champion Paper Company, or other high gloss calendered heavy paper stock such as a 60 lb. ream weight, makes a desirable original label ply 12. This original label stock ply is undercoated with a pressure sensitive adhesive. The pressure sensitive adhesive (13, 16) is preferably NICHOLMELT 1508 (a permanent pressure sensitive adhesive manufactured by Malcolm Nichol & Co., Hawthorne, N.J.), or equivalent pressure sensitive adhesive material.

The next ply, in this instance ply 15, is slightly larger (wider) than the original ply. In the area under the original ply it is coated with a vegetable wax 14. The wax is chosen from the group consisting of hydrogenated castor oil (caster wax) yellow Carnauba wax, bleached montan wax and other like waxes which have a melting point in a low range, between 100° C. and 65° C., and which are applied at temperatures above but near the melting point, and which are clear and transparent when applied to the carbonless transfer paper in a coating thickness of ½ to 2 mils.

The ply to which the wax coating 14 is coated is of a carbonless transfer paper. Additional plies likewise are formed of carbonless transfer paper, as previously stated.

Thus instead of utilizing 3M or NCR paper which is covered with a further barrier such as polyethylene which is in turn coated with silicone or bonded with silicone coated glassine to the carbonless transfer paper, the carbonless transfer paper in the present invention is preprinted and left unsealed except in those areas where it is coated with the release wax. The use of a release wax is especially advantageous in the process of manufacture. Additionally it is possible to overprint or write with common ball-point pens in the area where the wax has been applied in contrast to silicone surfaces.

Figure 3:
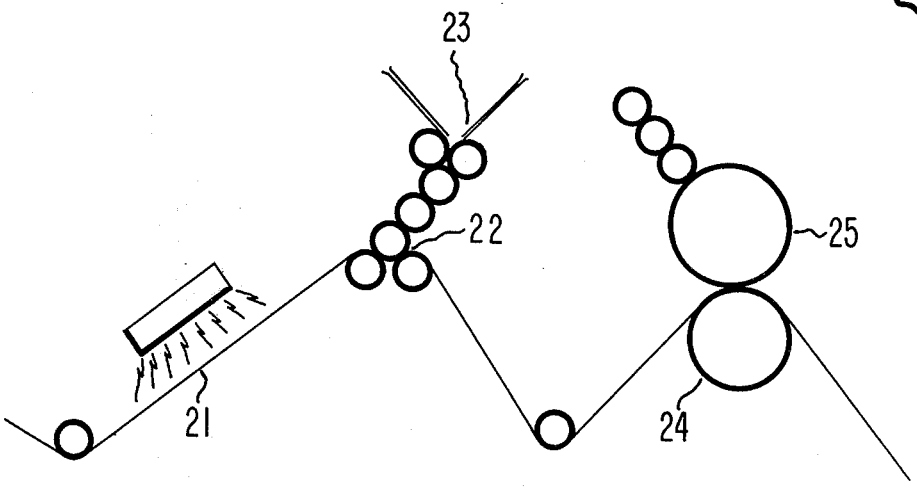

Accordingly as shown in FIG. 3, a web 21 can be printed utilizing a letterset or gravure type rotary press in which the web 21 is passed through a printing position which includes a pressure plate 24 and an ink type roll 25 and subsequently the web after being printed is passed through a hot wax striper 22 or spot application in which heated wax from a reservoir 23 which is passed downwardly through offset rollers 22 to be applied at the appropriate positions to the moving web 21. Use of the hot melt waxer in line with the rotary press permits selective application of the release wax. This means that the entire web need not be printed with wax but only those areas where it is appropriate.

Figure 2:
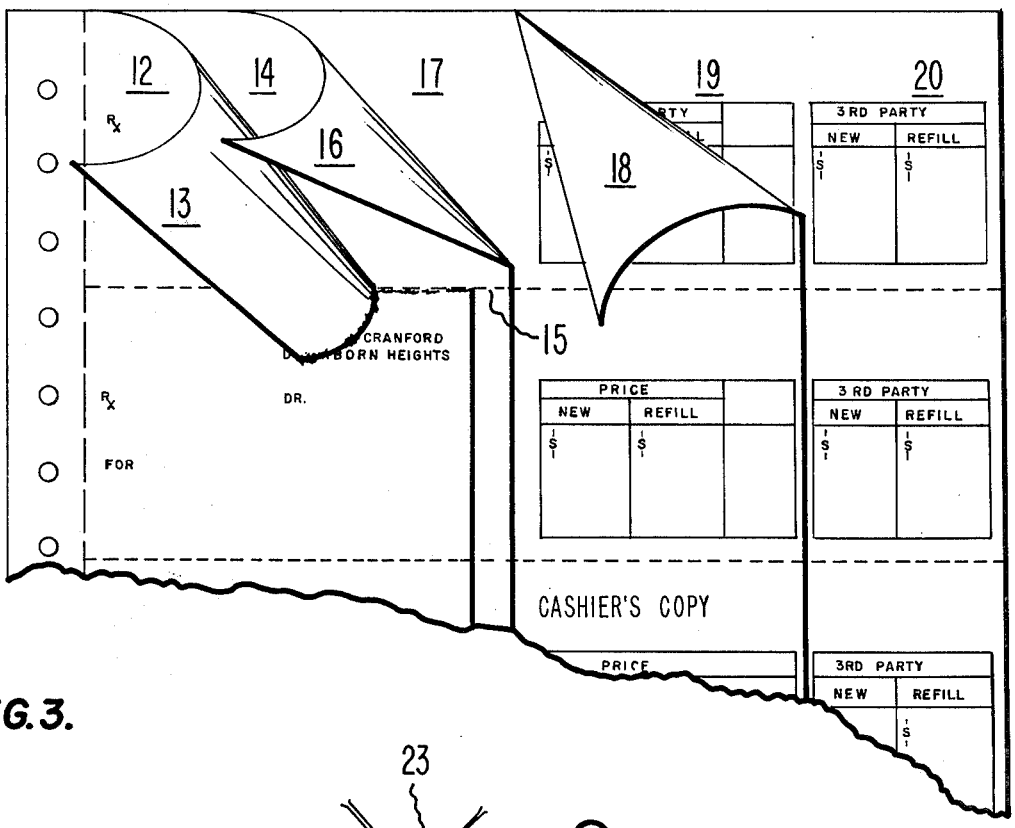
FIG. 2 is a plan view of a portion of the manifold according to the invention; and, FIG. 3 is a schematic view of the printing apparatus which is utilized in producing the printed stock which is subsequently assembled to form a manifold according to the invention.

The preferred wax application has the advantage as opposed to silicone. The wax is very fast drying because the wax is applied at temperatures so near the melting point that the wax sets before reaching the next roller, and the web 21 can be rewound without the necessity of using the large and expensive driers and time, as would be required of conventional silicone. Thus the web can be rerolled quickly as part of an automatic cycle and when the printed roll is complete, the roll can be assembled to form one ply of a completed manifold. The manufacture of the manifold itself is of a known type. Plurality of webs are unrolled together from their rollers and are gathered together in a proper sequence. They are glued at the edge, pressed and bound and cut and placed in appropriate transfer containers. The finished construction of the manifold can be best seen in FIG. 2. Therein is illustrated a prescription manifold. The pharmacist will type the prescribing Doctor's name on the form and the customer's name, other required prescription information and the like. The first ply 12 will be stripped off and pressure sensitive adhesive 13 on the back of the label 12 will provide the necessary adhesion to the container for the prescription. The second label 15 with its self-adhesive pressure sensitive back 16 can be used as an auxiliary label. Here it will be noted that a portion 14 of the face of the label bears wax in only the portion underlying the face stock 12.

Additional plies 18, 19 and 20 are provided of an appropriate kind of carbonless transfer paper for instance NCR CFB or 3M's Action brand paper. This paper is preprinted as described above and if the second ply 15 is backed with a pressure sensitive adhesive 16 then the face portion 17 of ply 18 which underlies the ply 15 also is stripped with wax.

Again the hot wax coating station is preferred. This is desired at a hot wax coating station as previously described. The group of waxes previously outlined can have added to the group a nonwax silicone of the catalyzed low temperature short curing time silicones which may be obtained from DuPont. These silicones require curing within the time and temperature ranges mentioned above and are acceptable substitutes for the wax coatings. Such an application would be preferred in the instances where a die cut is desired to be made in the label original sheet 12. In other instances the wax coatings are preferred.

It is seen that the above described pharmacy label will have other uses. For instance, a packing slip is part of the form and it is both a prescription label 12 and an actual shipping carton label 15. Various modifications both of the manifold itself and the process of manufacture of the manifold will occur to those skilled in the art both now and in the future, and the description of the invention herein should be interpreted within the spirit and scope of the appended claims.

What is claimed is:

1. A manifold or multipart business form formed from an assembly of plys coated from rolls printed on a continuous web printing press, comprising an original label stock ply, said original ply being printed on the face and being undercoated with a pressure sensitive adhesive, a second ply underlying said original ply and consisting of unsealed carbonless transfer paper which before assembly into the manifold has been printed on its face and then has been coated on its face with a precoat of vegetable wax, and a third ply underlying said second ply which has been preprinted on its face and consists of a carbonless transfer paper.

2. A manifold according to claim 1 wherein the second ply is coated with wax in that portion underlying the above lying original ply.

3. A manifold according to claim 1 wherein said wax is a wax of the group consisting of:

hydrogenated castor oil or castor wax;
yellow Carnauba wax;
bleached montan wax.

4. A manifold according to claim 1 wherein said second ply is undercoated with a pressure sensitive adhesive, and there is provided a face coat of vegetable wax on said third ply in that area of the face of the third ply which underlies the second ply pressure sensitive adhesive.

5. A manifold according to claim 4 wherein there is provided an additional ply of carbonless paper transfer provided beneath said third ply.

6. A manifold according to claim 1 wherein the wax which is applied as a face coat has been applied at a temperature above and near its melting point before the second ply has been subsequently assembled as a portion of said manifold.

* * * * *

UNITED STATES PATENT OFFICE
CERTIFICATE OF CORRECTION

Patent No. 4,021,060 Dated May 3, 1977

Inventor(s) Dunham B. Seeley, and David R. Hassel

It is certified that error appears in the above-identified patent and that said Letters Patent are hereby corrected as shown below:

Col. 1, Line, "impace" should read -- impact. --

Signed and Sealed this

*Thirteenth* Day of *September 1977*

[SEAL]

*Attest:*

RUTH C. MASON
*Attesting Officer*

LUTRELLE F. PARKER
*Acting Commissioner of Patents and Trademarks*